US011819050B2

(12) United States Patent
Daniek et al.

(10) Patent No.: US 11,819,050 B2
(45) Date of Patent: Nov. 21, 2023

(54) CIGARETTE MAKER

(71) Applicant: Körber Technologies, Inc., Richmond, VA (US)

(72) Inventors: Michael Daniek, Richmond, VA (US); Shengji Yang, Richmond, VA (US); Hamid Atai, Richmond, VA (US)

(73) Assignee: KÖRBER TECHNOLOGIES, INC., Richmond, VA (US)

( * ) Notice: Subject to any disclaimer, the term of this patent is extended or adjusted under 35 U.S.C. 154(b) by 138 days.

(21) Appl. No.: 17/451,947

(22) Filed: Oct. 22, 2021

(65) Prior Publication Data

US 2022/0125098 A1 Apr. 28, 2022

Related U.S. Application Data

(60) Provisional application No. 63/105,649, filed on Oct. 26, 2020.

(51) Int. Cl.

| | |
|---|---|
| ***A24C 5/32*** | (2006.01) |
| ***A24C 5/39*** | (2006.01) |
| ***A24C 5/33*** | (2006.01) |
| ***A24C 5/18*** | (2006.01) |
| ***A24C 5/28*** | (2006.01) |

(52) U.S. Cl.

CPC ..... *A24C 5/333* (2013.01); *A24C 5/185* (2013.01); *A24C 5/1821* (2013.01); *A24C 5/28* (2013.01); *A24C 5/327* (2013.01); *A24C 5/395* (2013.01)

(58) Field of Classification Search

CPC ..... A24C 5/333; A24C 5/1821; A24C 5/327; A24C 5/395

See application file for complete search history.

(56) References Cited

U.S. PATENT DOCUMENTS

| | | | |
|---|---|---|---|
| 2,243,058 | A | 5/1941 | Wysong |
| 4,446,876 | A | 5/1984 | Brackman |
| 5,542,901 | A | 8/1996 | Atwell et al. |

FOREIGN PATENT DOCUMENTS

| | | |
|---|---|---|
| WO | 00/16647 | 3/2000 |

OTHER PUBLICATIONS

International Search Report and Written Opinion, International Application No. PCT/US2021/071994, dated Apr. 25, 2022, 18 pages.

*Primary Examiner* — Michael J Felton
*Assistant Examiner* — Daniel Edward Vakili
(74) *Attorney, Agent, or Firm* — Saliwanchik, Lloyd & Eisenschenk

(57) ABSTRACT

A system for manufacturing cigarettes is provided. The system can include an easily removable and/or replaceable metering device that use a cavity drum to dispense a filler material, a modular garniture format parts bank that can be removed and replaced as a single unit from the cigarette manufacturing machinery, and a cutter head having components operated with a single motor that turns a spline shaft.

14 Claims, 16 Drawing Sheets

CIGARETTE MAKER

CROSS-REFERENCED TO RELATED APPLICATION

This application claims the benefit of U.S. Provisional Application Ser. No. 63/105,649, filed Oct. 26, 2020, the disclosure of which is hereby incorporated by reference in its entirety, including any figures, tables, and drawings.

BACKGROUND

Cigarette producing machinery is quite complex and costly. The pre-processed filler material is measured out with a metering device. The key component in a metering device is the metering drum, also known as a "picker roller". Currently, metering drums are constructed with a multitude of needles or blades arranged on the outer perimeter of the metering drum. This design is more suitable for processing long fiber filler material rather than smaller particles including dust. The metering device should also be easy to clean because certain filler material, such as cannabis-based products and some tobacco blends, can be quite sticky. The metering drum often requires the most attention when cleaning, but needles or sharp blades on the perimeter can prove to be quite difficult to contend with and also hazardous for the operator. In addition, the stickier the filler material, the more frequent cleaning is necessary. It can take considerable time to clean the machine parts that are soiled from the sticky material (metering rollers, garniture format parts, etc.). Unfortunately, these components in current cigarette machines are not designed for quick access or removal.

Cigarette producing machinery commonly operates by forming a continuous cigarette rod which is cut into discrete lengths. It involves intricate mechanisms such as, for example, a vacuum conveyor with a trimmer to produce cigarettes with high weight accuracy. Such complex and expensive technology is typically not cost effective for use with lower priced cigarette production machines. On the other hand, there is still a need to produce cigarette rods of a fairly consistent weight. Pre-processed tobacco, hemp, and marijuana, referred to herein as "filler material," is fed through machinery that employs multi-stage rollers and separators. The filler material is then dispensed onto a conveying device. In order to create an even and precise path of filler material, the filler material will adhere to the conveyor by the means of a vacuum and will be precisely trimmed by a rotating knife to uniform layer thickness as it moves along.

The trimmed filler material forms a strand, which will be subsequently released from the vacuum conveyor to be pre-formed into a cylindrical shape and wrapped into a cigarette paper. The result is a round and continuous rod. This "endless" rod will be cut to a specific length in subsequent steps.

State of the art cigarette producing machinery uses parts designed to preform tobacco into a cylindrical shape, wrap the formed tobacco within a roll of cigarette paper, and glue the overlapping seam so an "endless cigarette rod" is continuously produced. These parts are arranged in-line and fixed to a machine bed or frame. These parts are also known as "garniture format parts". The garniture format parts can be adjusted to improve the cigarette rod appearance. To produce a different cigarette rod diameter, the garniture parts may be replaced with a different set of parts. This is known as a format "change-over", and this procedure requires the machine to stop, power down, and remain powered down until the format change is completed. In addition, the format parts involved in such a "change-over" take time to disassemble and reassemble in the machinery. The individual parts must be unbolted from the machine bed or frame and new parts have to be individually bolted back to the machine frame. Most likely, some adjustment will also need to be done to ensure that the replacement parts are performing correctly. This is a time consuming procedure during which the machine is not producing.

As mentioned, it is not unusual for the garniture format parts to also require periodic cleaning because of the sticky nature of the tobacco blends or cannabis products. Some of the format parts, such as, for example, the rod forming tongue, have direct contact with the sticky material, which tends to adhere to the parts and accumulate to a point where a thorough cleaning is necessary to continue operation. In this case, the soiled garniture format parts must be removed and cleaned, which tends to be more time-consuming and results in longer downtime.

The current technology in tobacco cigarette machinery requires two motors, one for driving the cigarette rod cutter head and another for driving the acceleration wheel. This often increases the size of the machines and increases cost, which can make them unfeasible or at least less desirable for manufacturing lower cost cigarette products.

Current cigarette manufacturing machines also typically use a High-Speed Steel (HSS) knife with either a motorized grinding disk or spring loaded grinding stones to keep the HSS knife sharp. This arrangement also increases costs, due to the addition of a sharpener and reduces space around the HSS knife.

Existing spline shaft style Ledge Tubes have only rough adjustment points. This can result in loss of quality and consistency in the cigarette quality when operated at speeds above 100 cigarettes per minute (CPM).

BRIEF SUMMARY

Embodiments of the subject invention address the problems discussed above by providing improved cigarette manufacturing machinery with components that are easy to disassemble and clean, as well as an improved design that requires a single motor for rod cutting operation. Specifically, embodiments of the subject invention utilize simple and multiple metering drums, quick change garniture parts, and a single motor that operate with a spline shaft to drive both the cutting knife and the accelerating wheel.

Conventional metering drums (also known as "picker rollers") have sharp needles or blades attached to the outside of the drum perimeter for "picking-up" and processing long fiber tobacco, but which are not ideal for handling smaller pieces that may not be efficiently picked up the needles or blades.

Embodiments of the subject invention provide a cavity drum capable of handling and dispensing smaller particles eliminating the need for complex drums with sharp needles or blades. This can make the cavity drum easier and safer to handle and certain embodiments allow for a "quick change assembly". The entire cavity drum unit can be removed for cleaning, maintenance, or replacement, and quickly re-installed, thus saving valuable production time.

In addition, removing a conventional metering drum for cleaning can be cumbersome because metering drums currently used in cigarette manufacturing machinery are rather large. The metering drum can often be too bulky and possibly too heavy to be safely handled by the operator, particularly because of the sharp needles or blades. The use of a single or multiple cavity drums in place of a conventional metering drum in a metering device solves this problem. In one embodiment, multiple, removable cavity drums are used. In one embodiment, a cavity drum has a diameter that can be smaller than a conventional metering drum and the improved design can make the removable cavity drum assembly easier to handle.

A typical cigarette manufacturing machine has lower channel parts mounted to a machine frame. The lower machine parts usually have a U-shaped channel by which a garniture belt is guided. The garniture belt is consequently shaped by the channel into a U-shape. Atop the U-shaped garniture belt rests a narrow strip of cigarette paper unwound from a roll (bobbin) in which the continuous line of tobacco, hemp, or other "filler material" is deposited. On top of the garniture belt, cigarette paper, and the filler is a set of individual upper format parts such as, for example, a rod forming tongue, pre-folding block, diameter control folding block, etc. that perform different operations in manufacturing a finished cigarette rod. The upper format parts can be bolted to the machine frame and "sandwich" the garniture belt, the cigarette paper, and the filler with the lower channel parts.

The garniture belt is typically an endless narrow conveyor belt, which conveys the continuous stream of filler material on top of the cigarette paper through the format parts. After the filler material is wrapped in a continuous length of cigarette paper—the garniture belt carries the continuous length of cigarette rod to a cutter head. It is important that the format parts be precisely positioned relative to the garniture belt, so that they are the proper distance and position to shape the cigarette paper and the filler material as it passes by on the garniture belt. In the event the garniture belt must be removed or the garniture format parts are changed for a different size in order to produce a different diameter cigarette rod, it is necessary to disassemble the individual format parts from the machine frame, which is a time-consuming operation.

One embodiment of the subject invention employs a modular garniture format parts bank. With this embodiment, the lower channel, which includes the lower format parts, is referred to as the "bank" to which all the upper format parts are securely connected, such as with bolts. The bank, the garniture belt, and the upper format parts can be configured as a removable modular unit. The garniture belt can be removed with the between the bank and the upper format parts by releasing a tension roller.

A "quick format parts replacement" option is a cost saving feature in any production environment. This option is even more beneficial in a high speed production environment, such as cigarette manufacturing where one machine is capable of producing about 16,000 cigarettes each minute. Having the ability to quickly remove garniture format parts is particularly advantageous for two reasons. First, when cigarette rods of different diameter are being manufactured, the operator can have one or more banks available with format parts already bolted thereto and properly adjusted to the different product sizes. The replacement of one format to another can be simpler and takes much less time. If it becomes necessary to clean the format parts, an identical bank with garniture format parts can be ready and available to quickly replace the set that needs to be cleaned.

Conventional cigarette manufacturing machinery has multiple moving parts involved in cutting the cigarette rod, typically driven with at least two motors.

Embodiments of the subject invention provide a cutter head designed to operate with one motor to drive the operations of the cigarette manufacturing machine. In one embodiment, a single motor drives a spline shaft and a cam disk. The spline shaft can rotate the cam disk to turn an acceleration wheel at a fixed ratio that matches the CPM (cigarette per minute) speed. The spline shaft can also rotate a cutting knife. An eccentric adjustment disk connects to a follower slot that can adjust the ledge tube movement based on the desired rod length precisely. The cutting system uses a single axis to drive both the knife cutter and the acceleration wheel. The simultaneous rotation and linear motion is achieved by a combination of spline shaft and cam adjustment disk. This eccentric adjustment disk enables precise and smooth product length change without exchanging parts.

The acceleration wheel can be driven by the same motor by rotation of the spline shaft. The speed of the acceleration wheel is proportional to the CPM production speed. It is not affected by the product length. Vacuum is applied through ports in the acceleration wheel to enhance the effect of the acceleration through sliding.

Carbide material can be used for the cutting knife. This eliminates the need for either passive or an active grinder. It saves footprint, reduces part and maintenance cost, and makes the assembly more economical.

It should be noted that this Brief Summary is provided to generally introduce the reader to one or more select concepts described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which.

DETAILED DESCRIPTION

Figure 1:
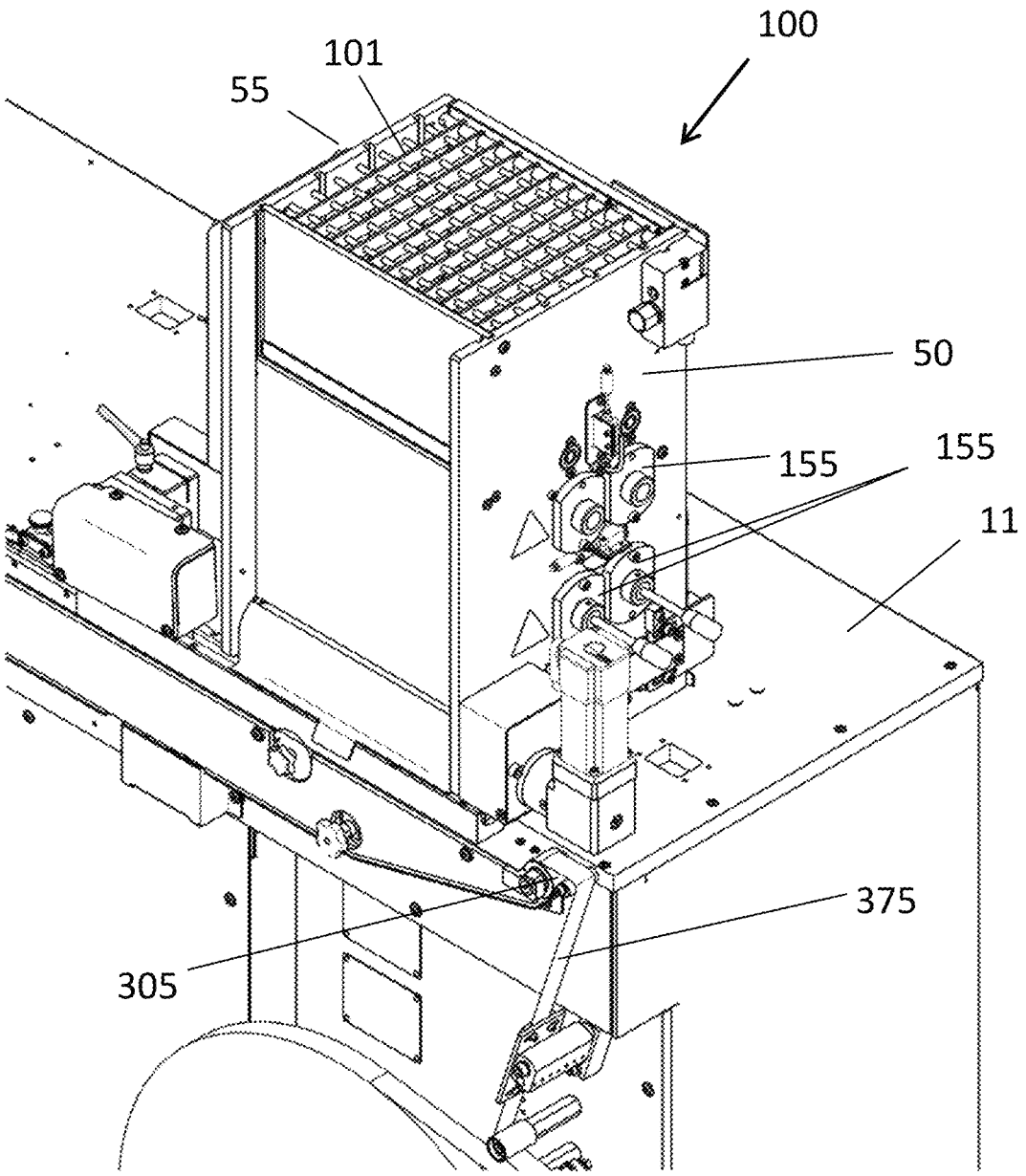
FIG. 1 is an illustration of a metering device that utilizes multiple cavity drums, according to an embodiment of the subject invention. Also shown is an embodiment of a modular garniture format parts bank.

Embodiments of the subject invention pertain to cigarette manufacturing machinery. More specifically, embodiments of the subject invention provide cavity drums that can be utilized in a metering device, a modular garniture format parts bank, and a cigarette rod cutter head that can be used with cigarette manufacturing machinery.

The following description will disclose that the subject invention is particularly useful in the field of cigarette manufacturing. A person with skill in the art will be able to recognize numerous other uses that would be applicable to the devices and methods of the subject invention. While the subject application describes, and many of the terms herein relate to, a use for cigarette manufacturing, other modifications apparent to a person with skill in the art and having benefit of the subject disclosure are contemplated to be within the scope of the present invention.

As used herein, terms indicating relative direction or orientation, including but not limited to "upper", "lower", "top", "bottom", "vertical", "horizontal", "outer", "inner", "front", "back", and the like, are intended to facilitate description of the present invention by indicating relative orientation or direction in usual use, and are not intended to limit the scope of the present invention in any way to such orientations or directions.

Also, as used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct, or indirect, physical or remote.

It is to be understood that the figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein. As used in the specification and in the claims, the singular for "a," "an" and "the" include plural referents unless the context clearly dictates otherwise.

Reference will be made to the attached figures on which the same reference numerals are used throughout to indicate the same or similar components. With reference to the attached figures, which show certain embodiments of the subject invention, it can be seen that embodiments of the subject invention pertain to components of cigarette manufacturing machinery 10 for dispensing a filler material 12. The machinery can include a metering device 100 that can utilize one or more cavity drums 150, a modular garniture format parts bank 300 that can be removed intact from the cigarette manufacturing machinery, and a combination spline shaft 400 and bevel gear 450 that can be rotated by a single motor 500 to operate a cigarette cutter head 600 that includes a knife 650 that cuts a cigarette rod into individual cigarettes of the proper length and an acceleration wheel 700 that advances the cut cigarette exiting a ledger tube. Each of these general components can have one or more sub-components, which will be discussed in detail below.

Figure 2:
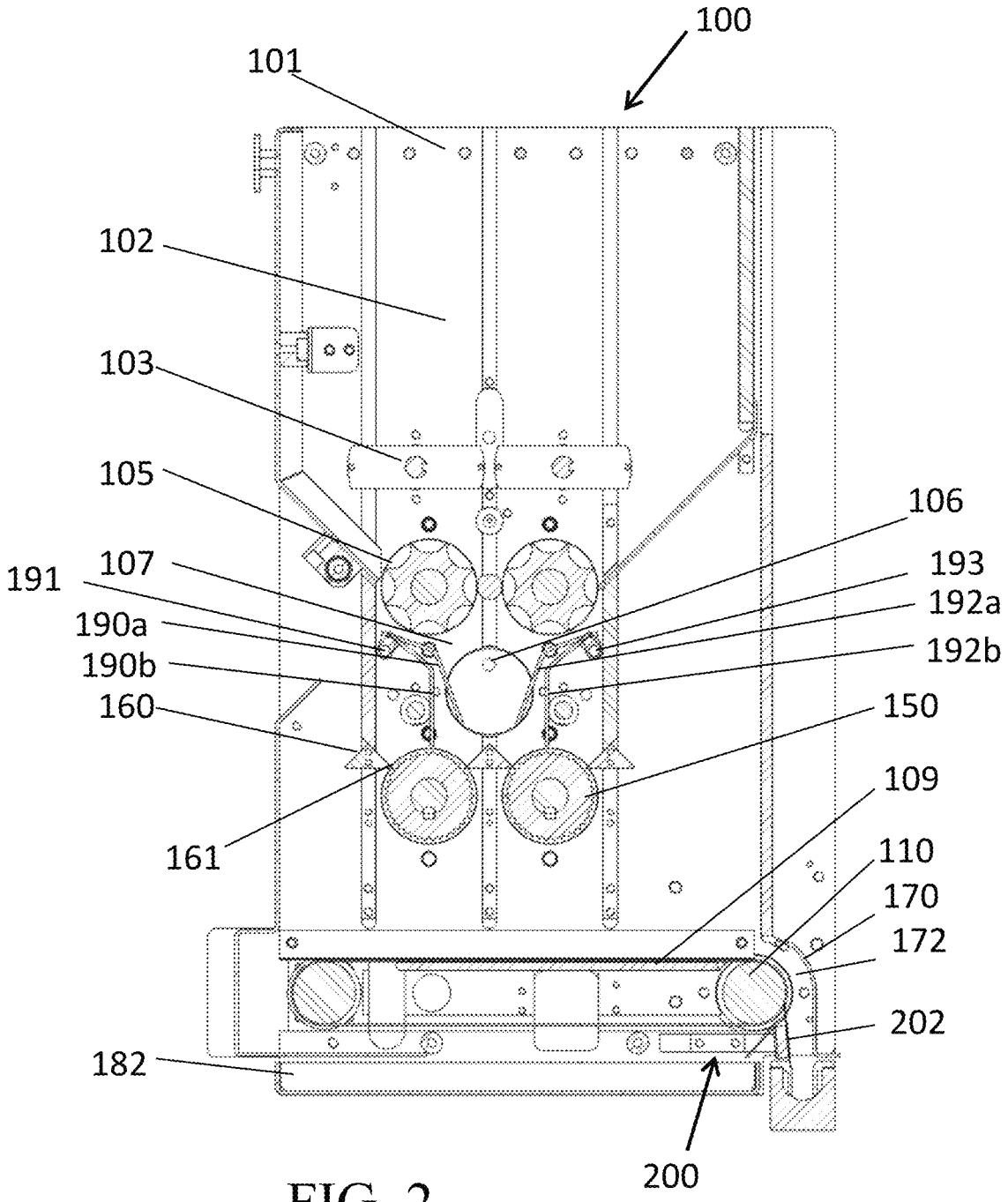
FIG. 2 is cross-section of the internal components of the metering device shown in FIG. 1.

The cigarette manufacturing machinery is used to form cylindrical shaped cigarettes. It can comprise separate components that perform different functions during the manufacturing process. The process can begin when an operator deposits a filler material 12, such as, for example, tobacco, hemp, marijuana, or similar types of material, through a fixed safety grid 101 and into the hopper 102 of a metering device 100, one example of which is shown in FIGS. 1 and 2. The filler material is separated in the metering device and deposited in an even layer on an apron conveyor 109. The process of separating the filler material starts with agitators 103 that break up the filler material to inhibit bridging or air pockets, so that the filler material sinks down and nests within rotary dispensers 105 that move portions of the filler material into a chute 107. The filler material in the chute is divided into smaller consistent portions deposited as a layer on the apron conveyor 109. The rotary dispensers 105 replenish the filler material in the chute 107 as it is depleted. The amount of filler material moved to the chute by the rotary dispensers can be determined by a minimum level sensor 106. The minimum sensor level has a vertical position that is adjustable, and that determines the minimum required filler level inside the chute. The metering device can further include a belt inner side scraper, a belt tensioner bolt, a dust collection pan 182, and a belt scraper bar 202.

A metering device 100 can have one or more cavity drums 150 arranged across the bottom of the chute. The filler material 12 inside the chute 107 covers the cavity drums 150. The filler material in the chute can be divided into smaller portions by the rotational operation of the one or more cavity drums 150. The cavity drums of embodiments of the subject invention have several advantages, including being smaller and lighter for easier handling, reducing the overall height of the metering device, and making it easier to deposit filler material from the hopper 102. One particular advantage of using more than one cavity drum of a smaller diameter is the ability to operate the cavity drums at a slower speed, allowing more of the filler material to nest and settle more effectively within the cavities 152 of the cavity drum and still maintain the optimal level or speed of operation.

Figure 3:
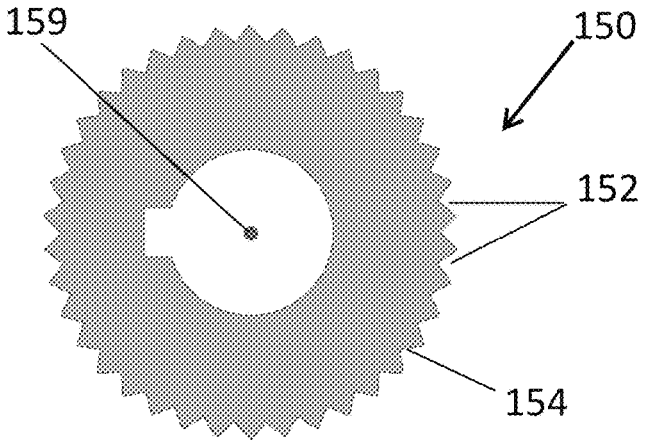
FIG. 3 is a cross-section of a cavity drum, according to an embodiment of the subject invention, having triangular cavities.
Figure 4:
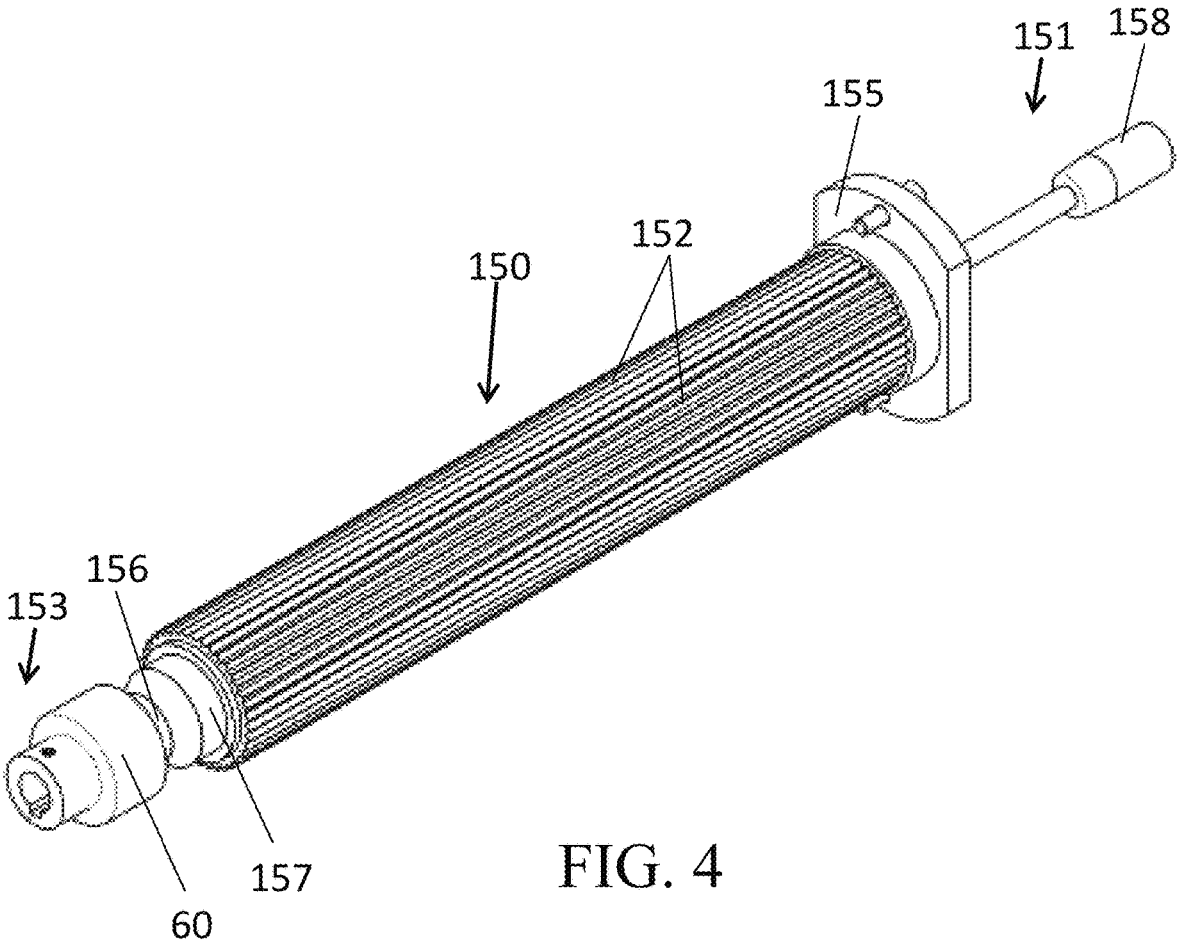
FIG. 4 shows a cavity drum assembly, according to an embodiment of the subject invention, having a handle, mounting flange, drum, and drive coupling.

In one embodiment, a cavity drum 150 is an elongated roller that has a plurality of elongated cavities 152 that extend along the length or axis 159 of the roller into which the filler material is deposited as the cavity drum is rotated. FIG. 4 illustrates an embodiment of a cavity drum. FIG. 3 shows a cross-section of a cavity drum 150 and illustrates an embodiment of the cavities 152. The cavity drums can rotate in the same direction or in opposite directions from each other.

As the cavity drums 150 rotate, the filler material passes between the cavity drums and one or more metering bars 160 positioned in proximity to the cavity drums. There can be a gap 161 between the rotating cavity drums and the stationary metering bar that controls the amount of filler material in the cavities 152. The gap can be adjustable.

Figure 6:
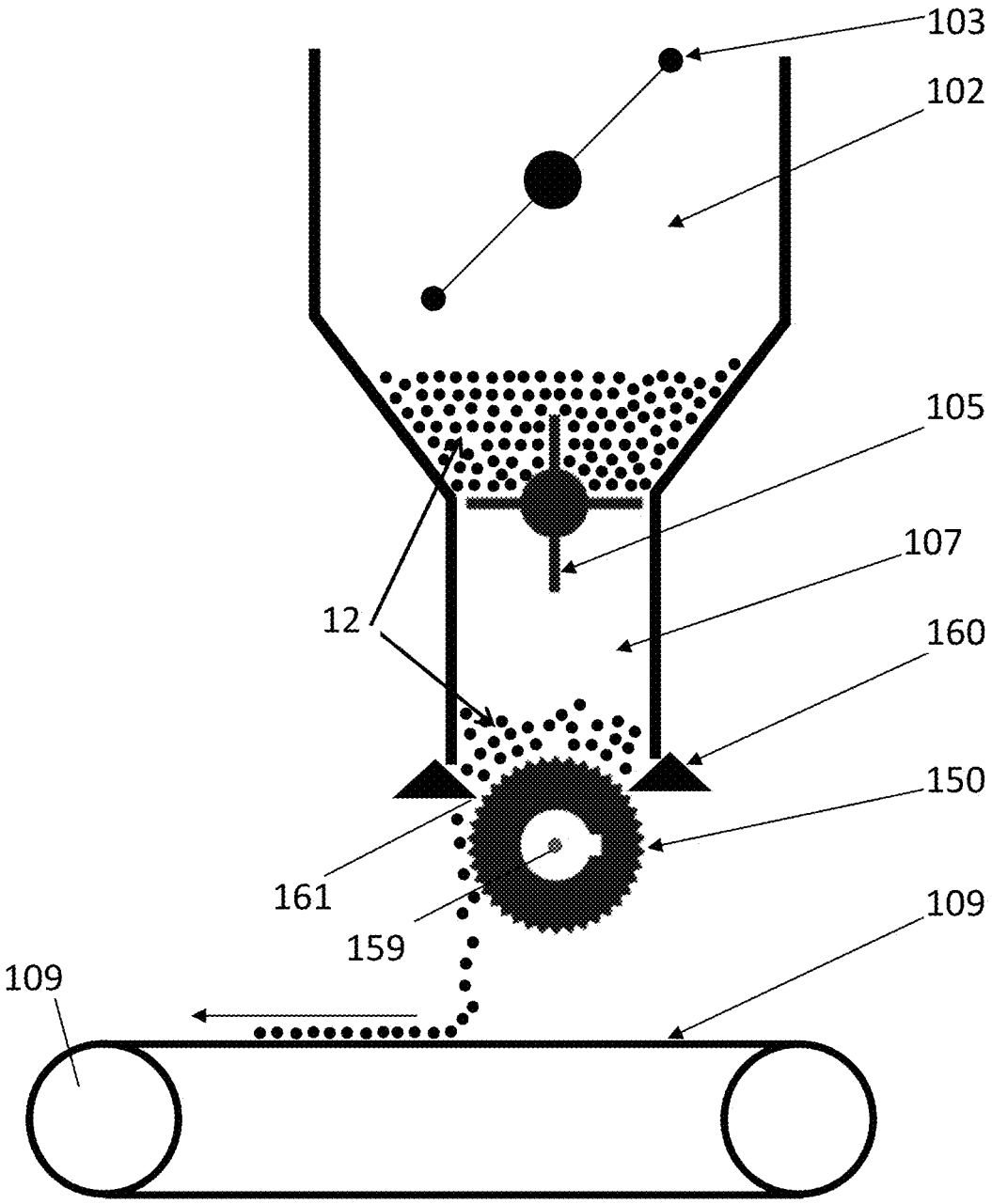
FIG. 6 shows a schematic of the operation of metering device utilizing a single cavity drum, according to an embodiment of the subject invention.

The filler material 12 in the cavities 152 is rotated around, past the metering bars 160, to provide a predetermined amount of filler material in each cavity. When the cavities rotate towards the bottom of the metering device, the predetermined amount of filler material then cascades down on top of an apron conveyor 109, as it leaves the cavities in the cavity drums. One example of this is shown in FIG. 6. In one embodiment, the apron conveyor propels the filler material in a direction that is perpendicular to the axis 159 of the cavity drums 150, as shown in FIG. 6. The movement of the apron conveyor propels the evenly spread filler material through a curved passage 172 formed between the apron conveyor's end-roller 110 and lid 170. The filler material lands onto a narrow strip of cigarette paper 375 positioned on top of atop a garniture belt 305 (indicated in FIG. 1). The filler material forms a consistent layer or stream on top of the cigarette paper strip carried by the garniture belt ready to be formed into a round cigarette and wrapped with cigarette paper to form a continuous cigarette rod. The uniformity of the dispensed material is advantageous for use with small inexpensive cigarette production machinery. If greater weight precision is required, the filler material dispensed from embodiments of a metering device can be picked up by a vacuum conveyor to be trimmed down stream. The more uniformly primed the filler material the more uniform is the metering process. Priming refers to the process of destemming, grinding, cutting, sieving, etc. the filling material to provide a more uniform product. The metering accuracy can also depend upon the diameter of the cavity drum 150, the shape and/or size of the individual cavities 152, the size of the gap 161 between the cavity drum and the metering bar 160 and upon the rotational speed of the cavity drum. The speed of the cavity drum and the gap can be adjustable. In one embodiment, these adjustments are handled with the format parts.

Some tobacco, but mainly hemp, can have small flakes that can be "scooped" with cavities 152 of the cavity drum 150 embodiments more effectively than can be done with needles or blades of a conventional metering device, which are intended more for longer fibers found in traditional cigarettes. The cavities being more effective at scooping the finer particle and dust can result in being more effective at processing hemp/marijuana cigarettes, because they utilize more of the filler material and minimize waste.

It can be important that the filler material is properly nested inside the individual cavities and is cleanly released as the cavity drum rotates over the apron conveyor. Though, some filler materials tend to be stickier than others. Stickier filler materials will require frequent cleaning. In one embodiment, a cavity drum 150 is removable from the metering device, allowing for quick and easy cleaning. State of the art machinery typically does not incorporate easily removable components because tobacco blends are mostly not tacky or sticky, whereas cannabis plants can have a fair amount of sticky resin. The cleaning of soiled components can take some time, even a few hours in some cases. This can cause undesirable production downtime.

The cavity drums 150 can be in direct contact with the filler material. Advantageously, cavity drums of embodiments of the subject invention can be modular, in that they can be easily removed and replaced within the metering device. This can allow the cavity drums to be cleaned and/or replaced or as necessary and/or swapped with other cavity drums, with minimal down time in production.

Figure 5:
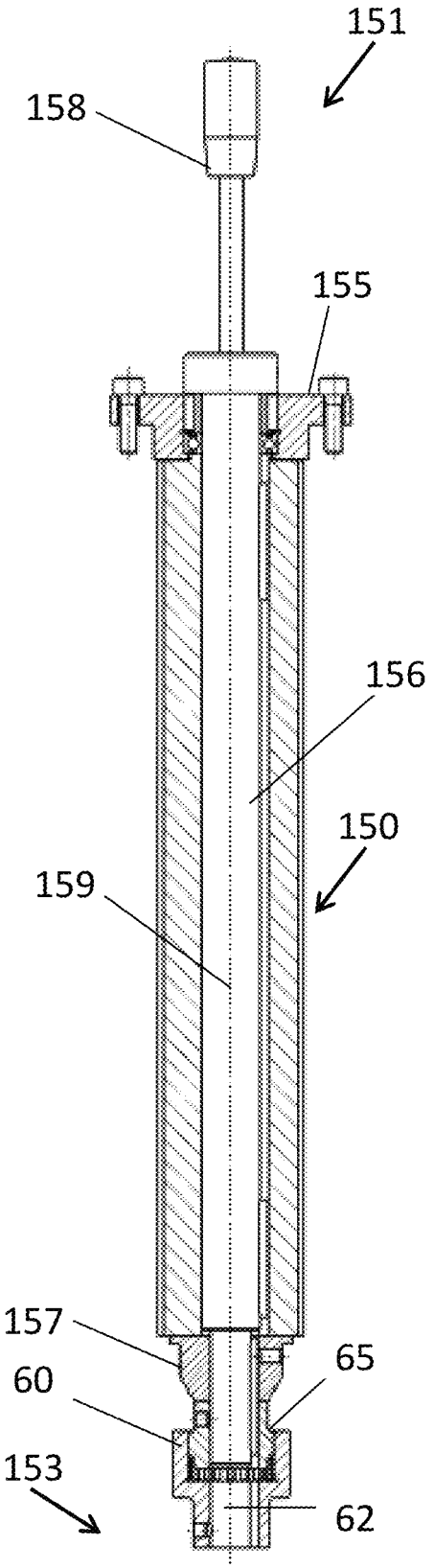
FIG. 5 shows a cross-section of a cavity drum, according to an embodiment of the subject invention.
Figure 7:
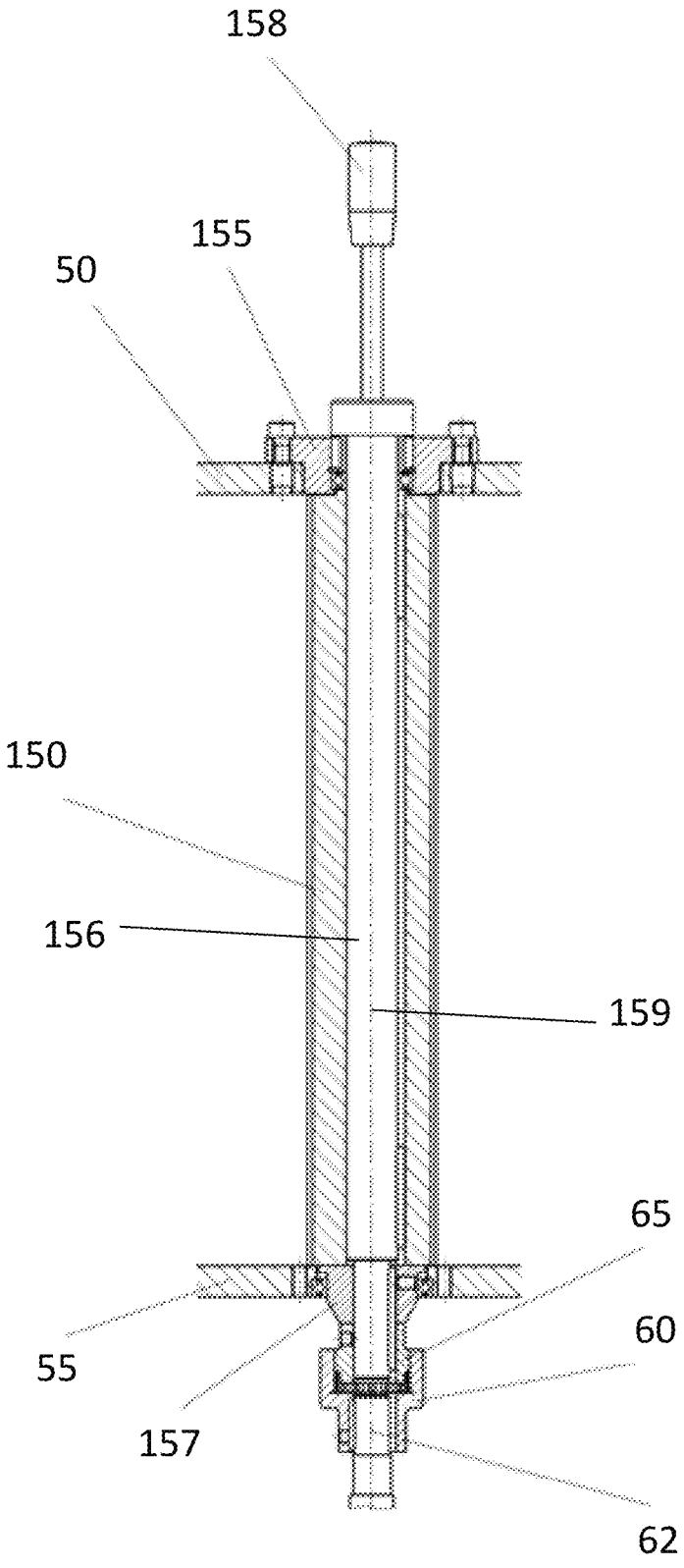
FIG. 7 shows a cavity drum operable attached to the sidewalls of a metering device, according to an embodiment of the subject invention.
Figure 8:
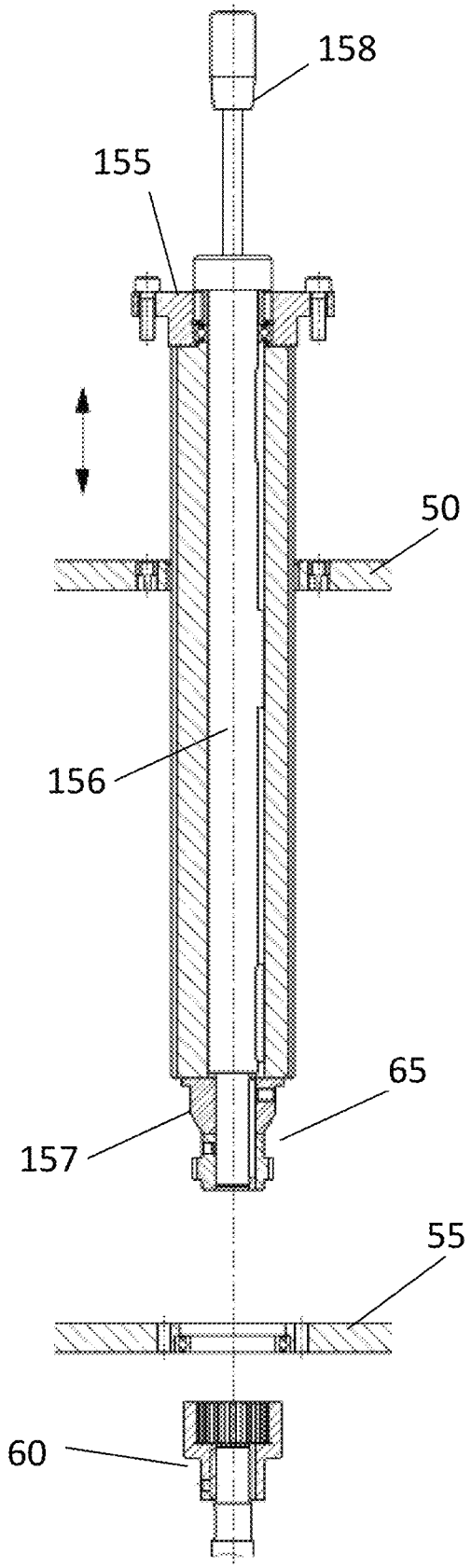
FIG. 8 shows a cavity drum as it would be inserted through the sidewalls of a metering device, according to an embodiment of the subject invention.

In one embodiment, a cavity drum 150 is constructed so as to be supported by a sidewall 50 and an opposite sidewall 55 of the metering device 100. The cavity drum can have an "operator end" 151 and an opposite "drive end" 153. In a further embodiment, the cavity drum 150 is removable, in a sideways manner, through an opening in the sidewall 50 of the metering device 100, and re-inserted therethrough after cleaning, an example of which is shown in FIG. 8. The drive end can be operably attached to the opposite wall 55 of the metering device. The cavity drum can include a shaft 156 running therethrough. A support disk 157 can slip inside a bearing installed in the opposite sidewall 55, and a male coupling 65 can mate with a female coupling 60 that is affixed to drive shaft 62, as illustrated, for example, in FIGS. 5, 7, and 8. The operator end 151 can have a handle 158 that can be used to remove the cavity drum and a mounting flange 155, to secure the operator end within the opening in the sidewall 50. Other techniques and devices can be utilized to secure a cavity drum within a metering device. Such variations that provide the same functionality, in substantially the way as described herein, with substantially the same desired results, are within the scope of this invention.

The design of the cavities of a cavity drum can depend upon the properties of the filler material. For example, the size of the cavities can directly depend on the size of the filler material particles. For another example, the surface roughness, surface treatment, and the material of which the cavity drum is fabricated can depend on the stickiness of the filler material. The perimeter 154 of the cavities in a cavity drum, seen in FIG. 3, can have any of a variety of shapes. The shape of the perimeter of the cavities in a cavity drum can be all the same or one or more of the cavity perimeters in a cavity drum can be different. In one embodiment, the perimeter 154 of a cavity has a triangular or angled shape, such as shown, for example, in FIG. 3. In an alternative embodiment, the perimeter of a cavity has a half-moon or curved shape. Ideally, the perimeter shape of the cavities makes them easy to be simply wiped clean. For example, a cavity drum can be cleaned by wiping with a few strokes parallel to the axis 159 of the cavity drum. Conventional metering drums that have needles or blades cannot be wiped clean and require use of a brush, pressured air or water, and possibly soaking the metering drum in a cleaning solution. It is within the skill of a person trained in the art to determine the one or more appropriate perimeter shapes for a cavity of a cavity drum. Such variations in the perimeter shape that provide the same functionality, in substantially the way as described herein, with substantially the same desired results, are within the scope of this invention.

Figure 18:
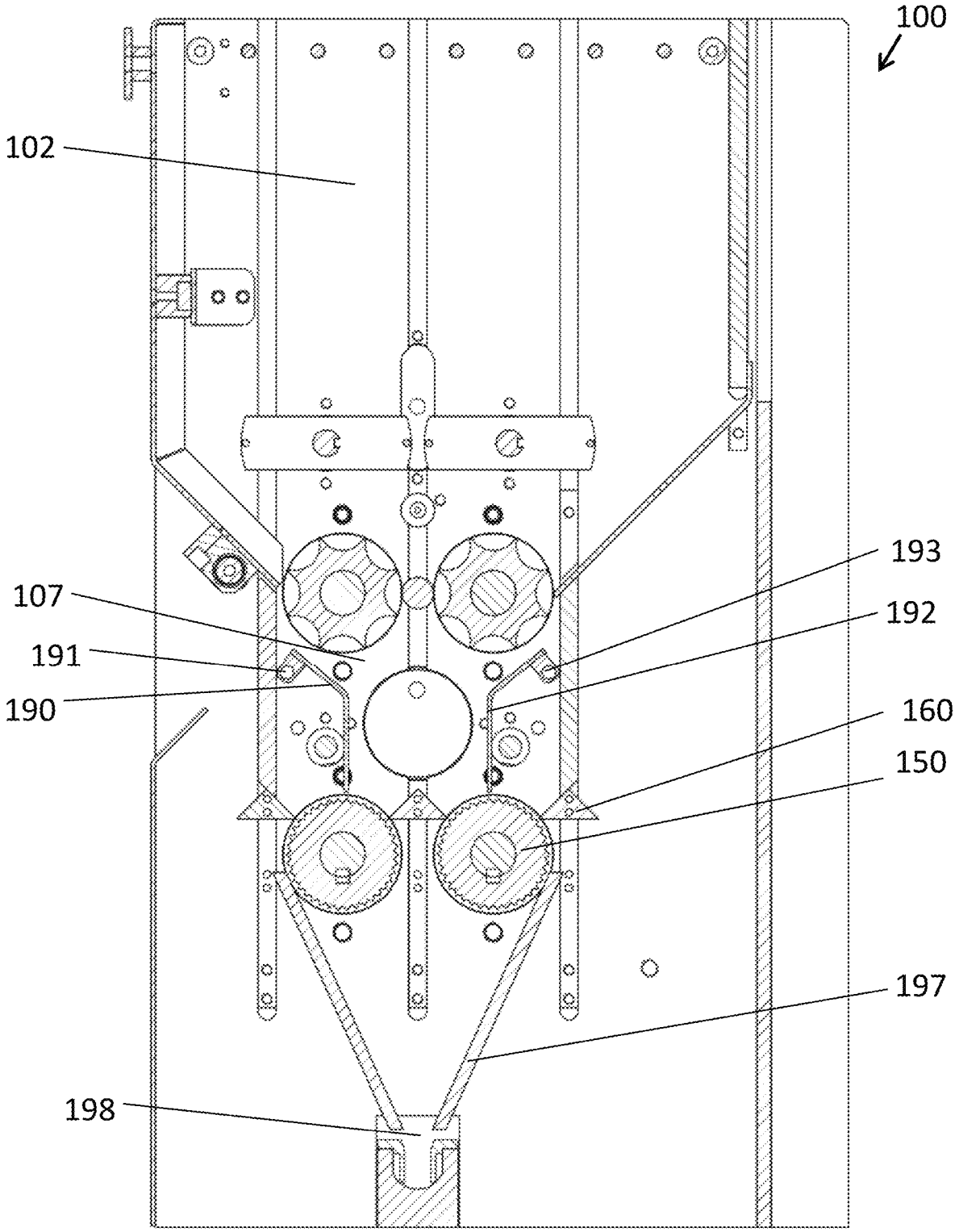
FIG. 18 is a cross-section of internal components of a metering device, according to an embodiment of the subject invention, which is configured to directly feed the filler material atop the cigarette paper transported on top of the garniture belt (e.g., inside the U-channel) instead of feeding on to the apron conveyer.

Some filler material 12 can be too moist or sticky and can benefit from being "fluffed-up" once sitting above the cavity drums 150, which helps to break possible air-pockets and nest the filler material 12 correctly inside the cavities 152 of the cavity drums 150. Thus, the metering device 100 can include skirts 190,192 in the chute 107 above the cavity drums 150, as seen in FIGS. 2 and 18. The skirts 190,192 can be actively driven and can be attached to respective drive shafts 191,193 at their respective top portions while their respective bottom portions are close to the cavity drums 150 (in an alternative embodiment, respective hinges can be used instead of the drive shafts). The reciprocating drive shafts 191,193 allow the skirts 190,192 to swing back and forth from a first position 190*a*,192*a* to a second position 190*b*, 192*b* and any position in between. The skirts can move back and forth such that the filler material is fluffed-up. Both skirts can move towards each other and away from each other, or the skirts can move in the same direction back and forth. Though FIG. 2 shows both positions 190*a*,190*b* and 192*a*,192*b* of the two skirts 190,192, this is for demonstrative purposes only; in operation each skirt 190,192 would only be in a single position (i.e., the first skirt 190 would be in the first position 190*a*, the second position 190*b*, or some position therebetween, and the second skirt 192 would be in the first position 192*a*, the second position 192*b*, or some position therebetween).

Once the filler material 12 has been spread onto the apron conveyor 109, as demonstrated in the example in FIG. 6, the filler material is moved onto a garniture belt 305 whereon a continuous stream of filler material is formed. The garniture belt forms a continuous loop, as shown in the examples in FIG. 9-13, which is sandwiched between a series of lower format parts and a series of upper format parts. The garniture belt moves through a U-shaped channel in the lower format parts and carries or transports the cigarette paper and continuous stream of filler material through these upper and lower format parts to form the cigarette rod. In conventional cigarette manufacturing machinery, the upper format parts and lower format parts are separate components attached to the machinery. If the garniture belt needs to be removed, some of these components has to be removed to access the garniture belt, sandwiched in between. When replaced, the components have be reattached to the machinery and precisely adjusted, calibrated, and tested before manufacturing can resume at speed.

Embodiments of the subject invention utilize a modular garniture format parts bank 300 that can be removed and reattached as a unit to the frame 11 of the cigarette manufacturing machinery. The modular garniture format parts bank 300 can include upper format parts 310 that are operably attached to a lower format parts bank 315 and sandwich or entrap the garniture belt 305 therebetween. In one embodiment, the modular garniture format parts bank 300 is attached to the frame of the cigarette manufacturing machinery at a predetermined location and secured with bolts, screws, hand knobs, snapping locks, or other means known in the art. One example of this is shown in FIG. 1. This modular system can eliminate the necessity of calibrating and testing the parts banks when reattaching or replacing the garniture belt, thereby reducing production downtime.

Figure 9:
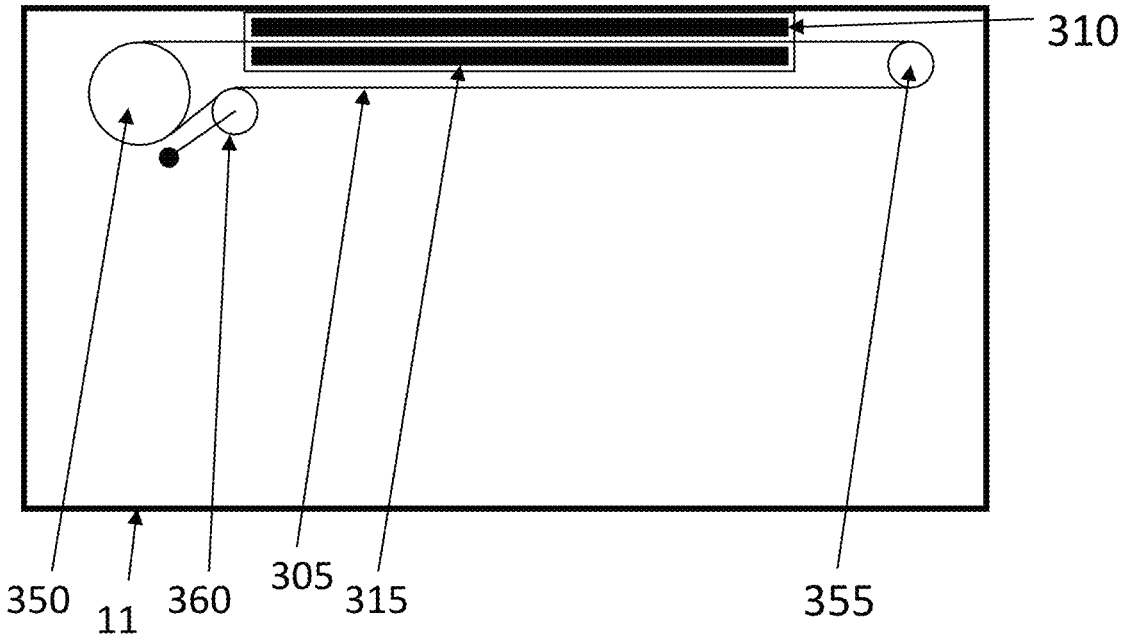
FIG. 9 shows a schematic of a garniture format parts bank, operably attached to cigarette manufacturing machinery, according to an embodiment of the subject invention. In this view the garniture belt is under tension.
Figure 10:
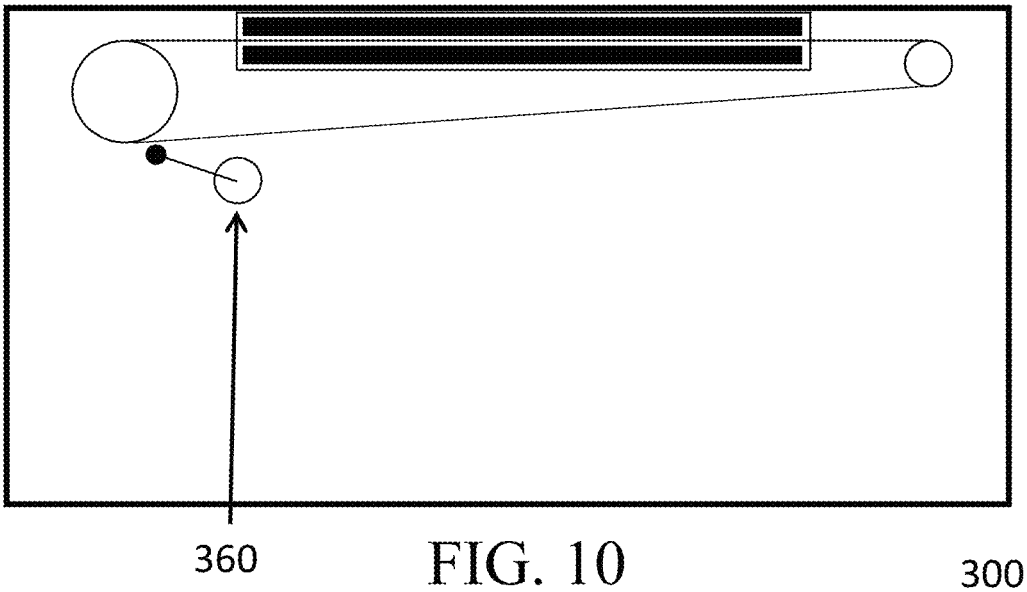
FIG. 10 shows a schematic of a garniture format parts bank, operably attached to cigarette manufacturing machinery, according to an embodiment of the subject invention. In this view the garniture belt is not under tension.
Figure 11:
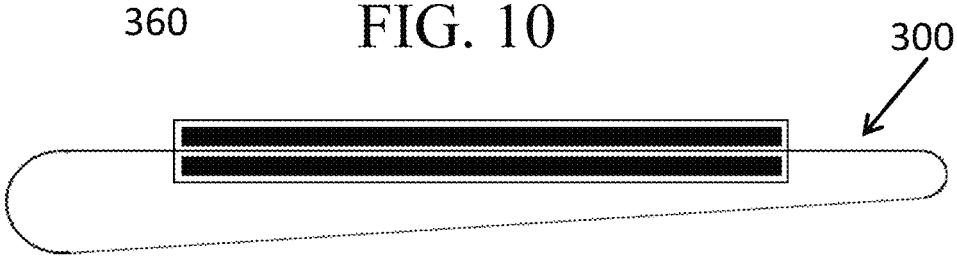
FIG. 11 shows a schematic of a garniture format parts bank, according to an embodiment of the subject invention.
Figure 12:
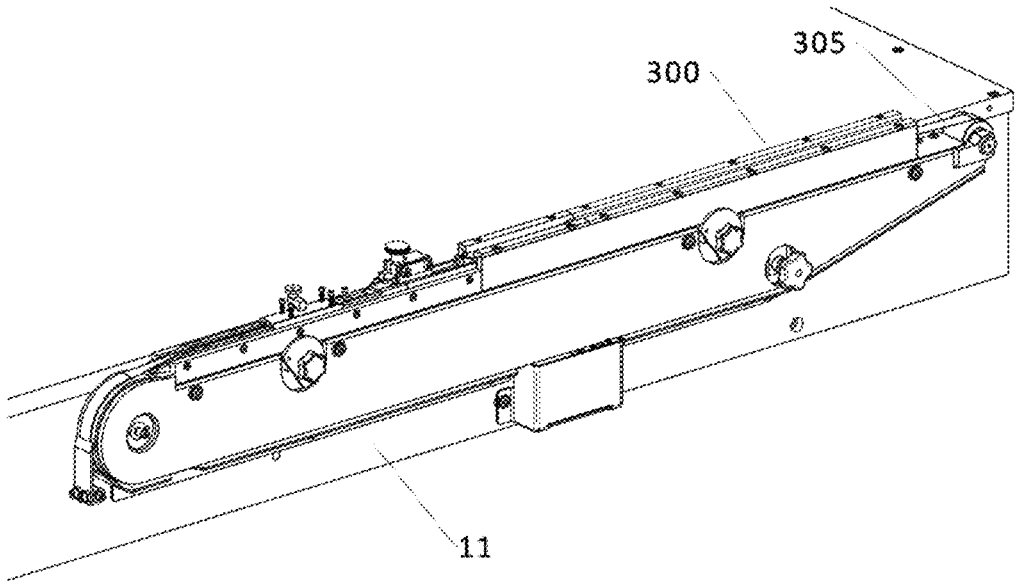
FIG. 12 illustrates a garniture format parts bank, operably attached to cigarette manufacturing machinery, according to an embodiment of the subject invention.
Figure 13:
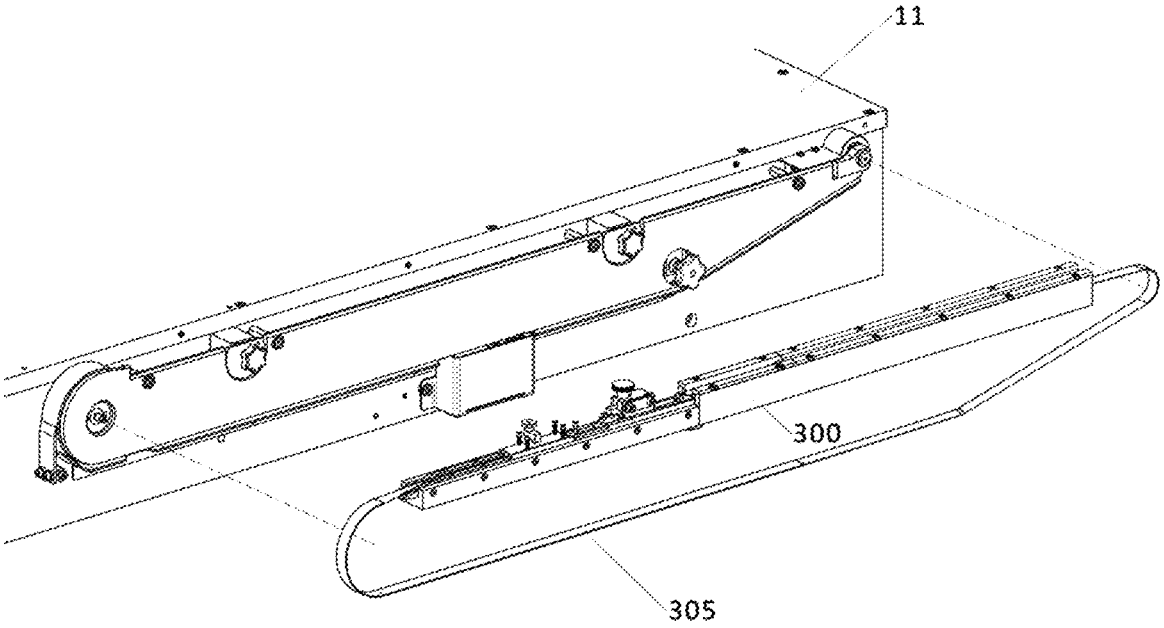
FIG. 13 illustrates a garniture format parts bank, according to an embodiment of the subject invention, detached from the cigarette manufacturing machinery.

The garniture belt 305 is rotated by operable attachment to a drive roller 350, a driven roller 355, and a tension roller 360, which each apply tension by taking up slack in the garniture belt, as shown in FIGS. 9 and 10. When the garniture format parts bank 300 is to be removed, tension must be released on the garniture belt, sandwiched therein. This can be achieved by releasing the tension roller 360 that is used to take up slack in the garniture belt. An example of a tension roller and the release of the garniture belt tension is shown by way of example in FIGS. 9 and 10. Once the tension on the garniture belt is released and the modular garniture format parts bank is unattached, these components can be completely removed, as a unit, from the machinery, as shown in FIGS. 11 and 13.

The garniture belt can move the stream of filler material through the modular garniture format parts bank 300 to be wrapped in continuous cigarette paper and glued closed in a long cigarette rod. This long cigarette rod is moved towards a cutter head 600 where the cigarette rod is precisely cut into individual cigarettes by a knife 650. In conventional cigarette manufacturing machinery, one motor is employed to operate the knife that rotates and cuts the cigarette rod as it passes through a cutting slot 625 in a ledger tube 620 and a second motor is employed to turn an acceleration wheel 700 that advances the cigarette rod on a V-way bed 630 downstream and therefore out of the ledger tube 620. The knife can be adjusted with a knife adjustment bolt 670. A safety interlock 680 can be used with a protection hood. The safety interlock 680 is a safety switch attached to the guarding/protection hood, locking the protection hood and inhibiting or preventing it from being opened during operation. If the guarding were to be opened during operation, the safety interlock 680 can stop the motion of the knife or the entire machine on the spot to inhibit or prevent injuries.

Embodiments of the subject invention provide a simplified cutter head 600 that utilizes a single motor 500 operably attached to a spline shaft 400 that is engaged with a gear 450 at a first end 410 to the motor at or near the second end 420. The single motor can drive the spline shaft, which turns the bevel gears 450, which turns the acceleration wheel 700 at a fixed ratio that corresponds to the CPM speed. The same motor can also drive the eccentric cam adjustment disk 800 (which can also be referred to as "eccentric adjustment disk"). The cam adjustment disk connects to a follower slot that precisely adjusts the ledger tube 620 movement based on the desired cigarette length. The ledger tube 620 must be synchronized with the knife rotation, and this is why it moves in linear fashion with the knife. The knife passes through the slot in the ledger tube and cuts the cigarette rod in the process. FIGS. 14-17 illustrate embodiments of a cutter head of the subject invention.

Figure 14:
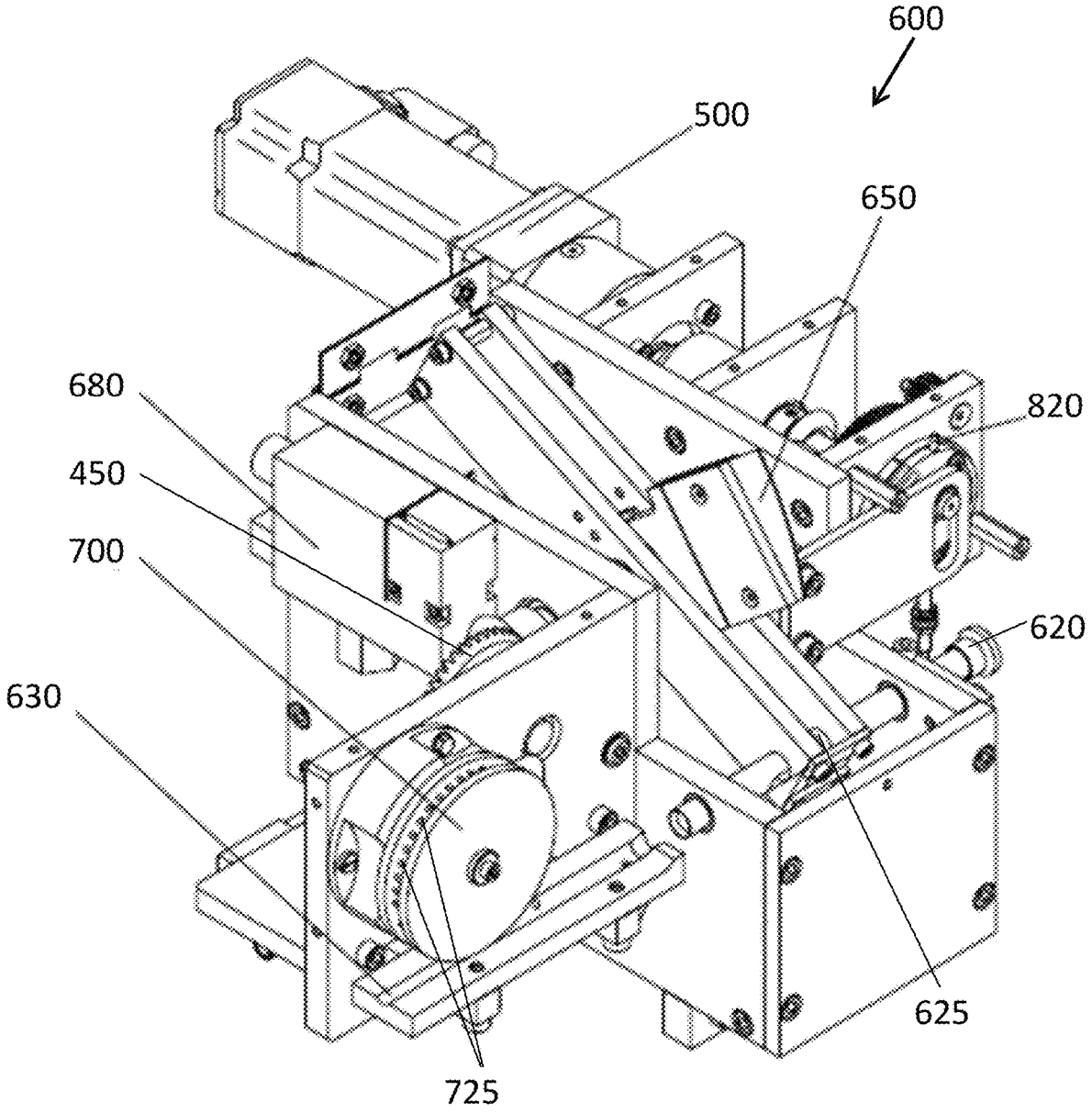
FIG. 14 illustrates a cigarette rod cutter head, according to an embodiment of the subject invention, having a single drive axis, an accelerating wheel, with fine ledger adjustment and knife.

The cutter head 600, such as shown in FIG. 14, uses the single axis of the spline shaft 400 to drive both a cutting knife 650 and the acceleration wheel 700. The simultaneous rotation and linear motion is achieved by the combination of the spline shaft and the eccentric cam adjustment disk 800. The eccentric cam adjustment disk 800, an example of which can be seen in FIG. 17, enables precise and smooth product length change without exchanging parts. The eccentric adjustment disk includes a ledger follower plate 830, a manual port 810, and a home position pin 820. The home position pin 820 can designate the position of the eccentric cam adjustment disk 800 recognized by the motor 500, thereby telling the motor 500 the home location; because the motor 500 can be equipped with a gearbox, it needs the external home sensor.

Figure 15:
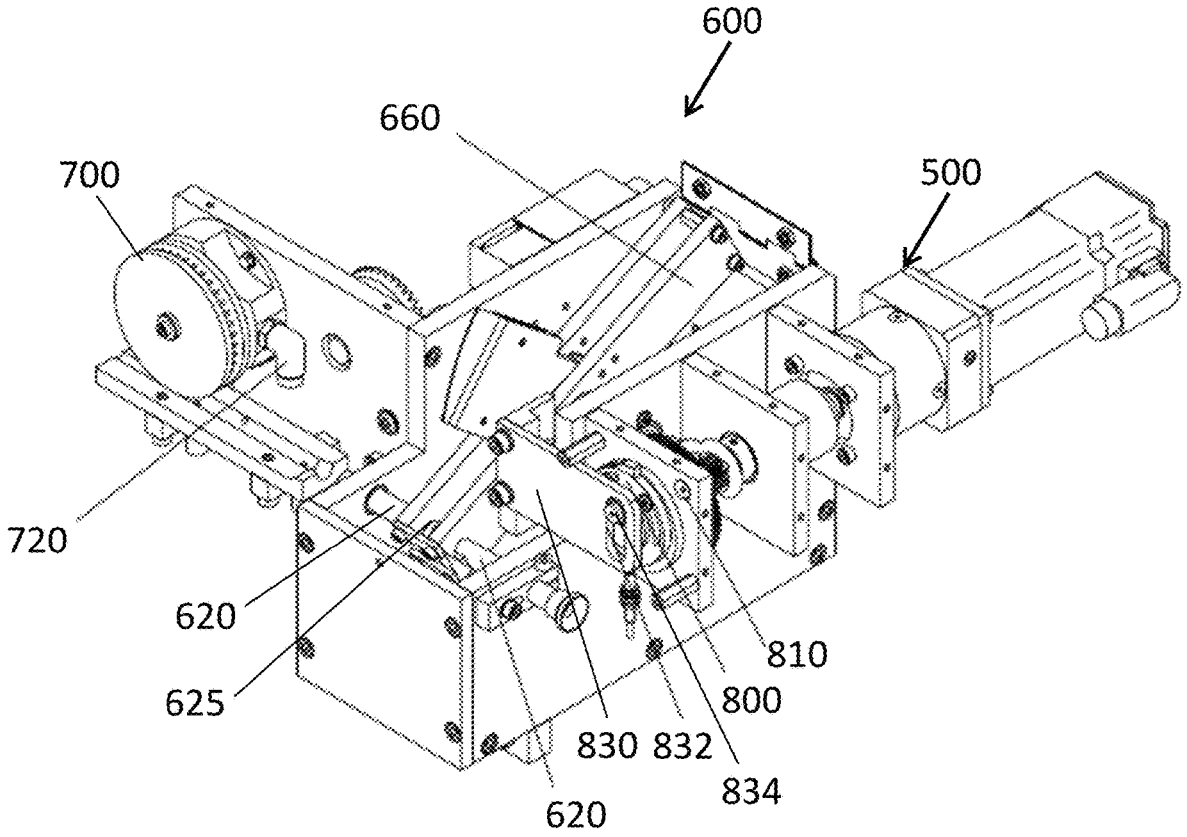
FIG. 15 illustrates another view of the cigarette rod cutter head of FIG. 14.
Figure 16:
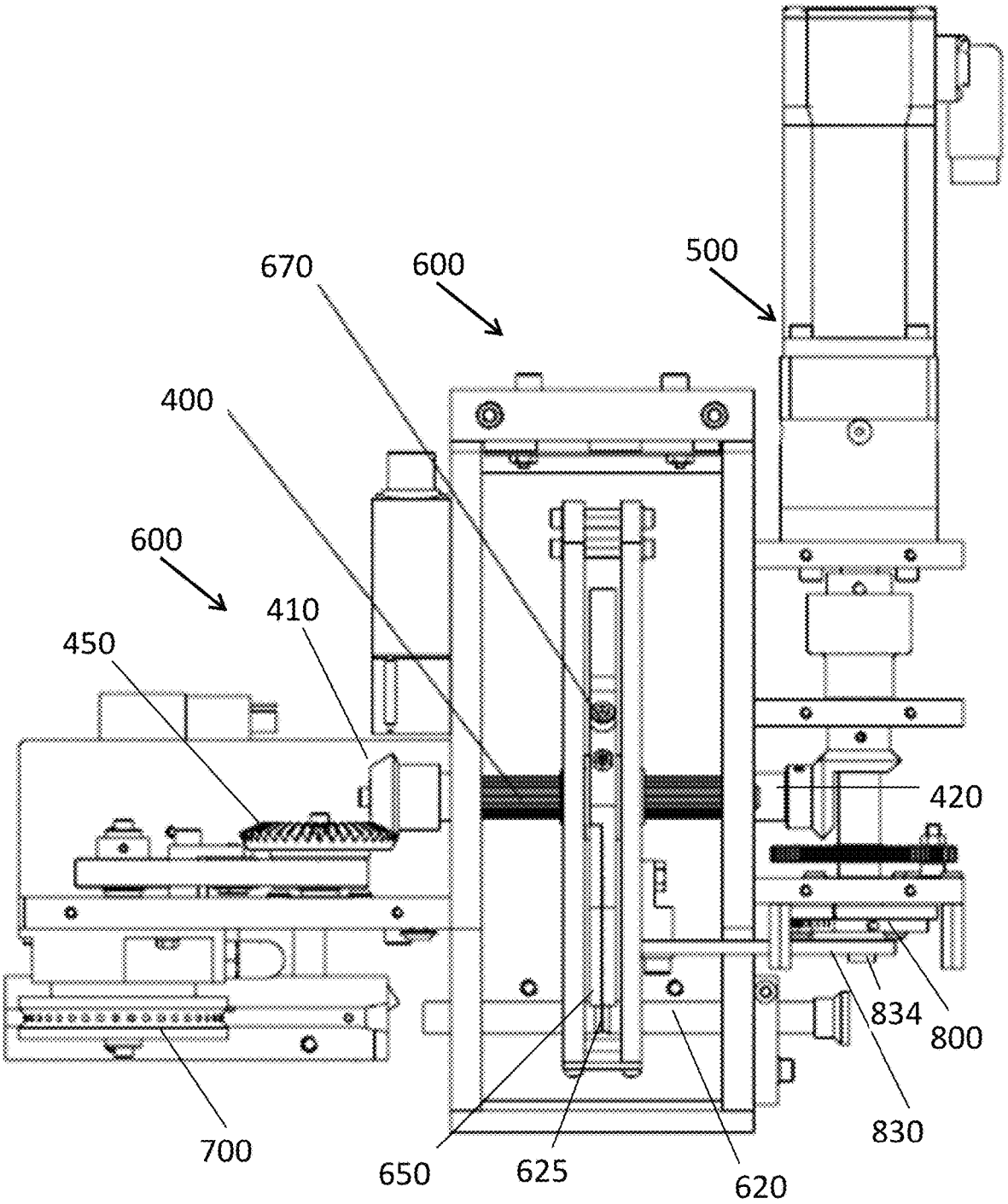
FIG. 16 is a top view of the cigarette rod cutter head, shown of FIG. 14.
Figure 17:
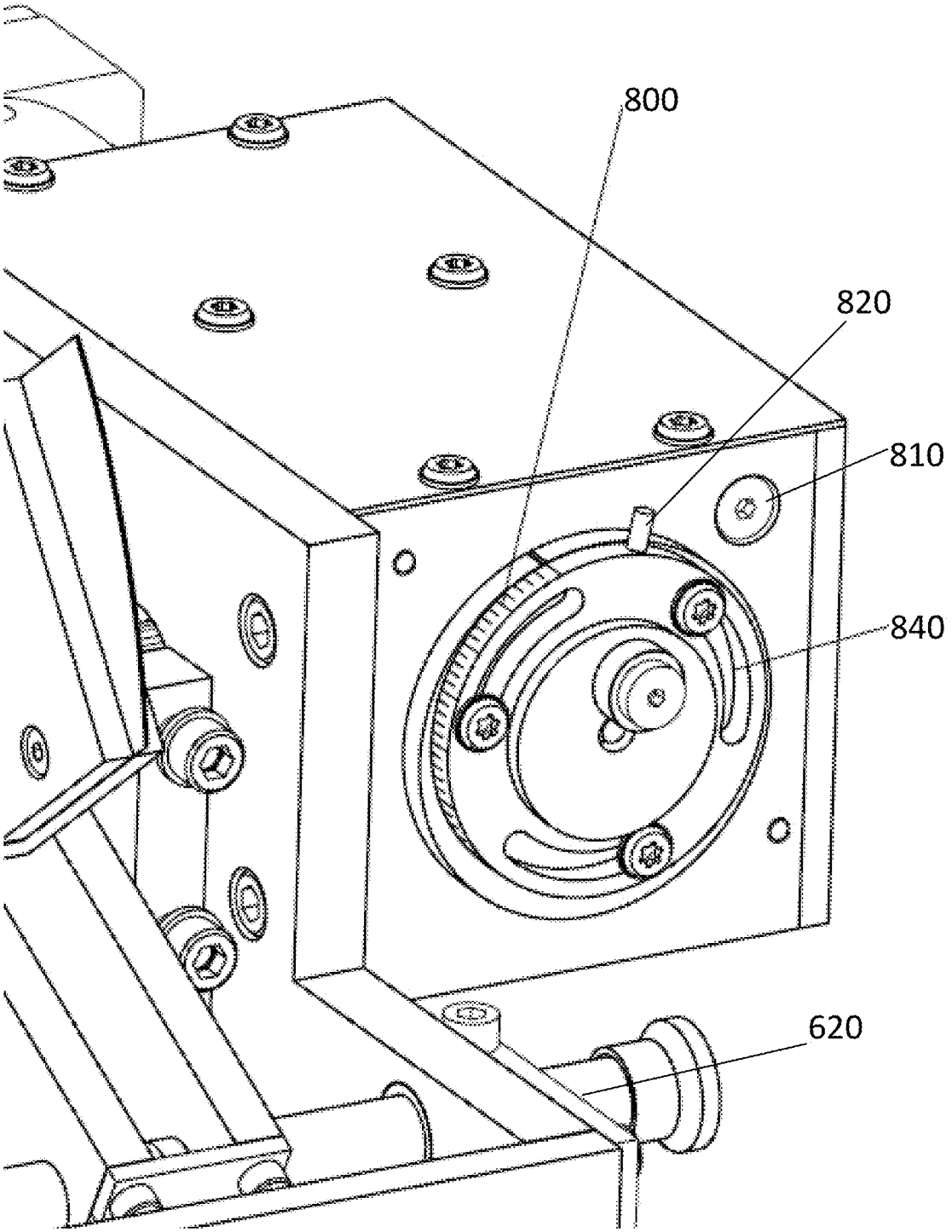
FIG. 17 illustrates an eccentric adjustment disk, according to an embodiment of the subject invention, which can be utilized on a cigarette rod cutter head.

The discharge acceleration wheel 700 is driven by the bevel gear 450 rotated by the same motor 500 through the spline shaft 400. The speed of the discharge acceleration wheel is proportional to the production speed and is not affected by the product length. In an embodiment, vacuum is applied to the acceleration wheel, having a plurality of vacuum ports 725 via an acceleration wheel vacuum line 720, shown for example in FIG. 15, to enhance the effect of the acceleration through sliding in the V-way bed 630. FIG. 16 demonstrates an embodiment wherein, in operation, the motor 500 rotates the spline shaft 400 and the eccentric adjustment disk 800. Rotation of the spline shaft provides rotation of the knife perpendicular to the axis of the spline shaft. The eccentric adjustment disk 800, in combination with a follower plate 830 causes the knife assembly to move in a linear fashion on a rotating spline shaft with combined movement. In one embodiment, the ledger follower plate 830 has a vertical sliding slot 832 in which an off-center post 834 extends through from the eccentric adjustment disk 800, as shown in FIGS. 15 and 17. The motor rotates the eccentric adjustment disk, the post revolves with the disk, causing it to move within the sliding slot and create a horizontal linear motion in the ledger follower plate. The ledger follower plate can be attached to a knife cage 660 in which the knife is located. As the ledger follower plate is moved horizontally by the post, the knife in the knife cage is also moved, along with the ledger tube. As the cigarette rod is passed through the ledge tube by the acceleration wheel, the knife swings around and cuts the cigarette rod through the cutting slot 625.

There can also be a knife cage 660 that controls linear motion of the knife. In one embodiment, the eccentric adjustment disk 800 has at least one fine adjustment slot 840 for adjustment of the position of the post, which adjusts the knife, relative to the cutting slot 625 position during rotation. This can provide more precise placement of the knife and inhibit breakage of the blade by hitting the ledger tube 620, through which the cigarette rod is passed for cutting. The fine adjustment slot(s) 840 can allow the eccentric adjustment disk 800 to be rotated thereby increasing or decreasing the rotation radius of ledger follower plate 830. With that, the linear motion (equal to two times the rotation radius) of the rotating knife cage 660 on the spline shaft 400 will be also increased or decreased. In a further embodiment, carbide material is used for the cutting knife. This can eliminate the need for either a passive grinder or an active grinder. This can provide a smaller footprint, reduce part and maintenance costs, and makes the assembly more economical.

Figure 19:
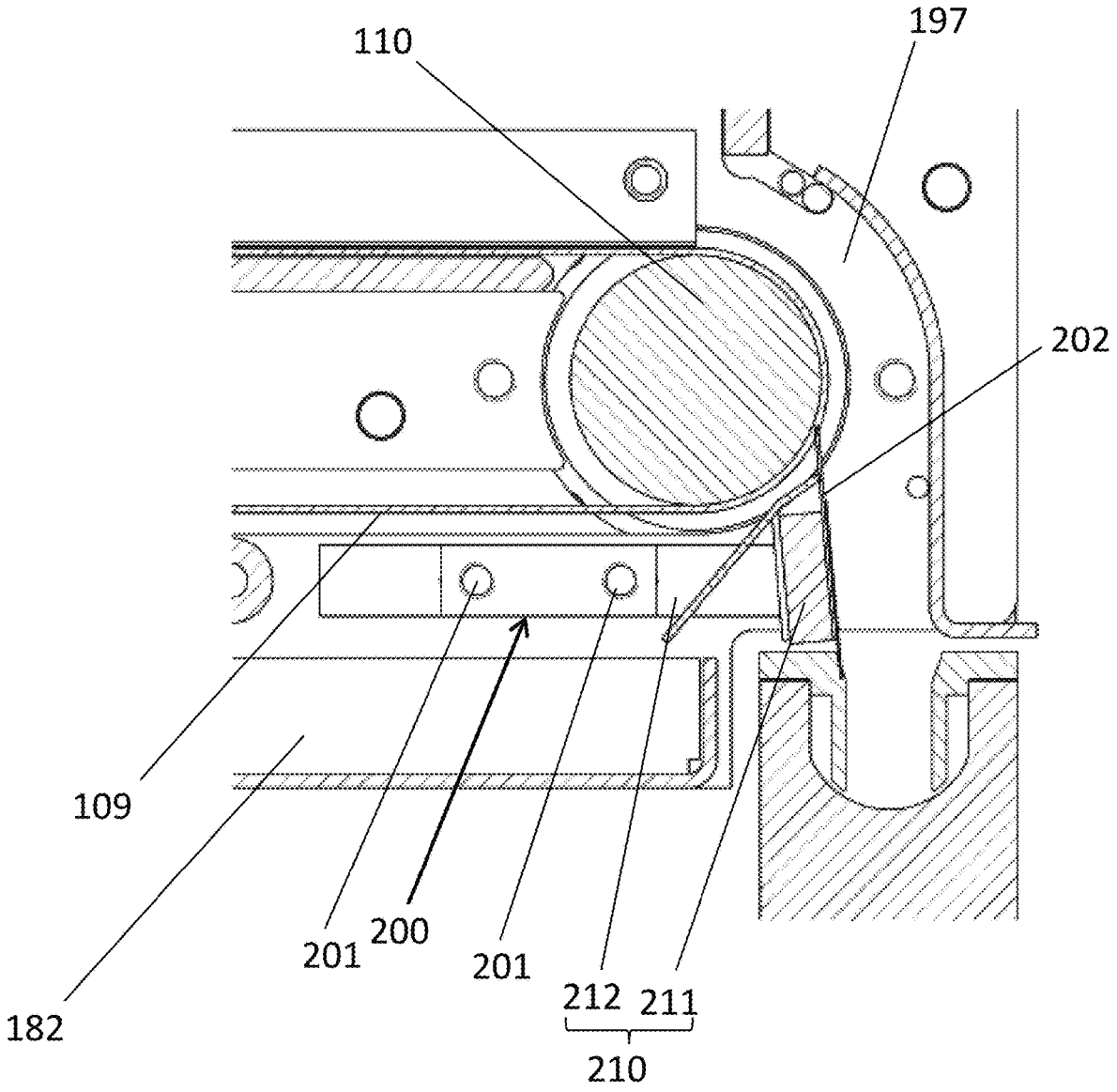
FIG. 19 illustrates a close-up of an apron conveyer and scraper, according to an embodiment of the subject invention.
Figure 20:
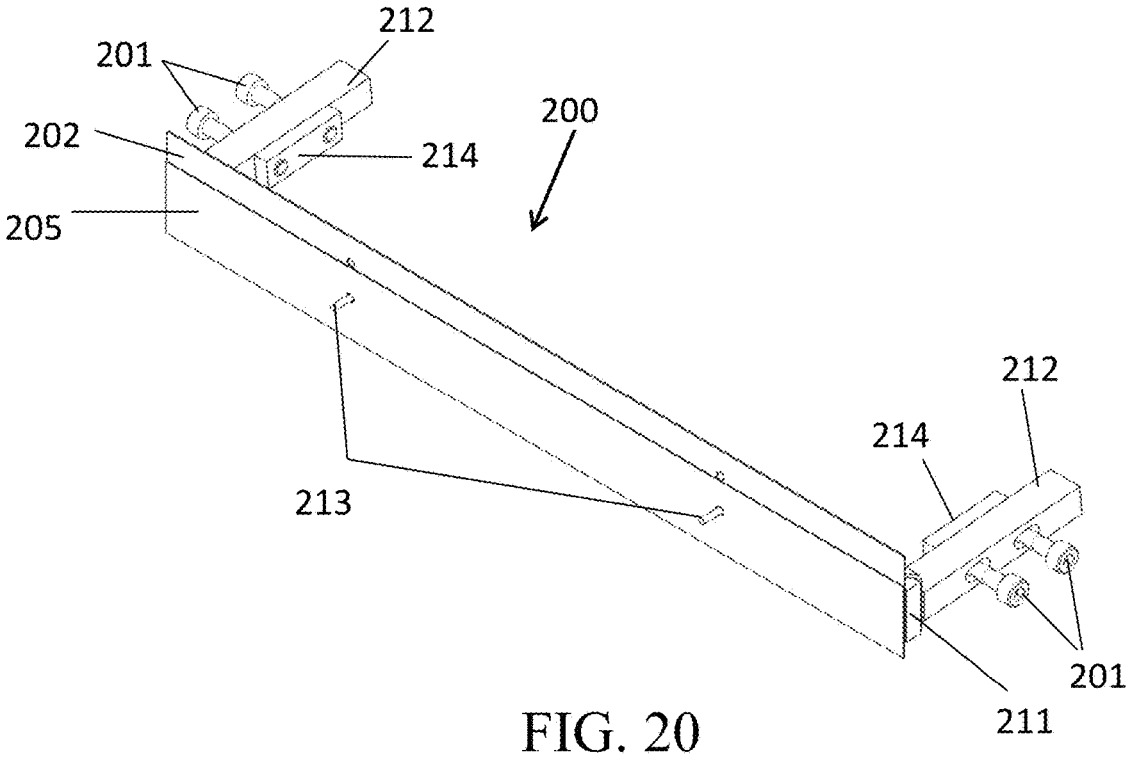
FIG. 20 illustrates a scraper that can be used with an apron conveyer, according to an embodiment of the subject invention.
Figure 21:
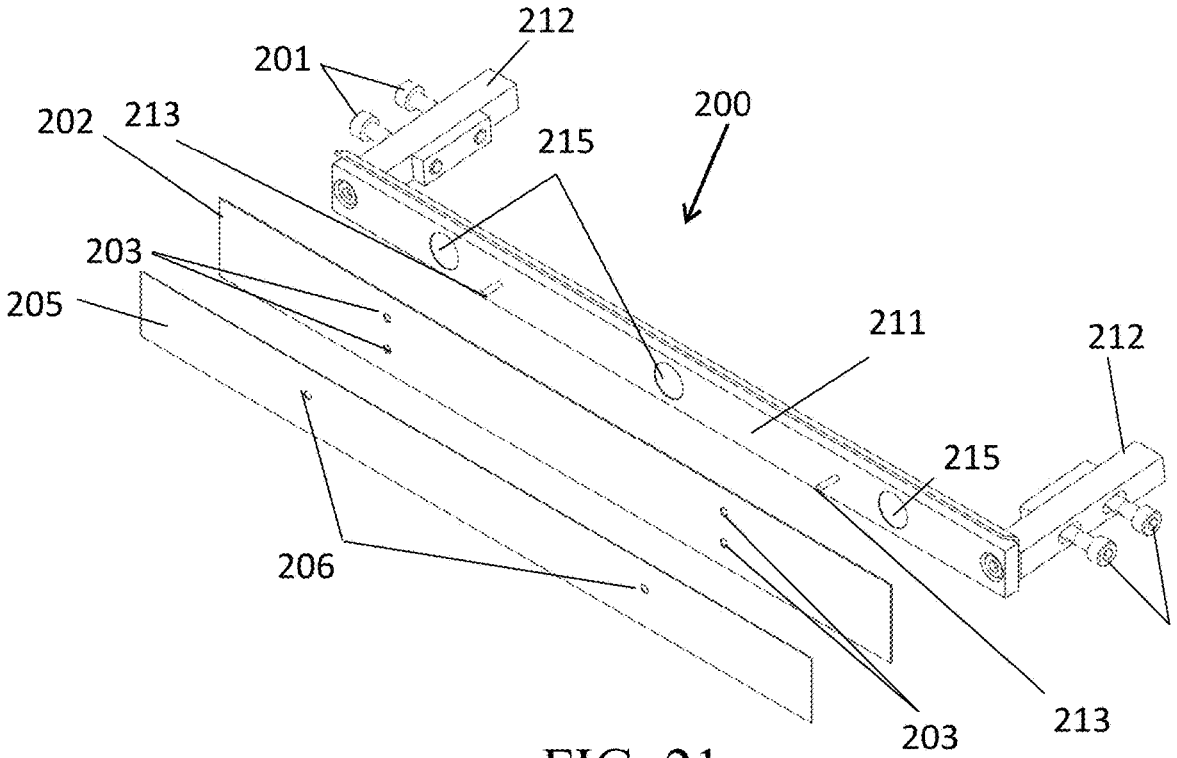
FIG. 21 is an exploded view of the scraper of FIG. 20.

Certain filler material (e.g., primed hemp (e.g., milled to smaller particles so it can be processed in the machine)) includes a considerable amount of fine dust. Some cigarettes manufacturers prefer the dust to be included in the product while some prefer to sieve it out. In some embodiments, a belt scraper 200 can be employed with the apron conveyor 109 to separate most or all of the dust from the solid flakes. The dust is collected in a dust collection pane 182 beneath the apron conveyor 109 and such fine dust can be used in other non-cigarette products such as creams, soaps, etc. The scraper 200 can help to separate the dust from coarse particles, and the gap between the scraper 200 edge (e.g., edge of element 202) and the surface of the belt of the apron conveyer 109 can be adjustable. FIG. 19 shows a close-up view of a scraper 200 and apron conveyer 109, according to an embodiment of the subject invention. FIG. 20 illustrates the scraper 200, with FIG. 21 showing an exploded view of the scraper 200.

In some cases the operation requires direct contact between the scraper strip 202 and the surface of the belt of the apron conveyer 109. The scraper strip 202 in certain embodiments can be configured to not wear off the belt. For example, the scraper strip 202, which contacts the filler material (and possibly the belt) can be made out of heavy weight paper (e.g., 200 grams per square meter (gsm) to 500 gsm, or about 200 gsm to 500 gsm). Such a paper strip may need to be replaced during the machine operation (e.g., about twice per 8-hour shift), so it can have a "quick change" tool-less feature for changing it out. The scraper assembly base 210 can include a bar 211 and two arms 212 and can be adjusted relative to the fixed surface of the belt of the apron conveyer 109. The arms 212 can be slotted for attachment to the chute 107 structure (e.g., via fasteners 201, which can be fastened to a connection structure 214; the fasteners 201 can be any suitable fastener, including but not limited to pins, screws, or bolts). The bar 211 can also include two pins 213 and one or more magnets 215. The scraper strip 202 can include holes 203 to match the location of the pins 213, such that the scraper strip 202 can hang on the pins 213.

The scraper strip 202 can be secured with a secondary strip 205 (e.g., a thin, flexible, metallic (magnetic) strip), which can also be equipped with two matching holes 206 for hanging on the pins 213. The secondary strip 205 can also have extra attachment to the bar 211 via the one or more magnets 215 (e.g., if the secondary strip 205 is magnetic). The secondary strip 205 hangs on the two pins 213, sandwiches the scraper strip 202 between itself and the bar 211 and makes sure that the edge of the scraper strip 202 stays in the desired location with respect to the surface of the belt of the apron conveyer 109 during operation.

In order to extend the life of the scraper strip 202, a second pair of holes 203 can optionally be included on the other side of the scraper strip 202; if the "working edge" of the scraper strip 202 becomes too moist, sticky, or wavy and therefore unusable, the operator can turn the scraper strip 202 upside down utilizing the second pair of holes 203 (e.g., by first removing the secondary strip 205, turning the scraper strip 202 upside down utilizing the second pair of holes 203, and then reattaching the secondary strip 205).

As mentioned, some producers want to include the dust from filler material inside the cigarette. Thus, in an embodiment, the apron conveyer 109 and scraper 200 can be omitted, and a funnel system can instead be included in the metering device 100, as shown in FIG. 18. Referring to FIG. 18, the metering device 100 can include a funnel portion 197 (e.g., two plates mounted beneath the cavity drums 150 in a fixed fashion or coupled with a vibrating device to help with the fill) below the cavity drums 150, which funnels the filler material from the cavity drums 150 to a passage 198 to the cigarette paper 375 transported on top of the garniture belt 305 inside the U-channel.

The transitional term "comprising," "comprises," or "comprise" is inclusive or open-ended and does not exclude additional, unrecited elements or method steps. By contrast, the transitional phrase "consisting of" excludes any element, step, or ingredient not specified in the claim. The phrases "consisting" or "consists essentially of" indicate that the claim encompasses embodiments containing the specified materials or steps and those that do not materially affect the basic and novel characteristic(s) of the claim. Use of the term "comprising" contemplates other embodiments that "consist" or "consisting essentially of" the recited component(s). When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. A metering device, configured to be used with cigarette manufacturing machinery, the metering device comprising:

a hopper comprising a first sidewall and a second sidewall opposite to the first sidewall, the hopper being configured to receive a filler material;

a rotating agitator within the hopper configured to rotate to agitate the filler material;

a rotary dispenser configured to rotate below the rotating agitator, into which the filler material is configured to pass after being agitated;

a chute, below the rotary dispenser, into which the filler material is configured to be deposited by the rotary dispenser;

a cavity drum having an operator end operably attached to the first sidewall and a drive end operably attached to the second sidewall so as to be positioned within and configured to rotate inside the chute, the cavity drum having a plurality of cavities into which the filler material in the chute is configured to be deposited; and a metering bar positioned to form a gap with the cavity drum, such that, when the cavity drum rotates, the filler material deposited into the plurality of cavities passes the metering bar, which controls the amount of filler material in the plurality of cavities.

2. The metering device according to claim 1, further comprising:

a first skirt attached to a first reciprocating drive shaft in the chute above the cavity drum and configured to swing back and forth via the first reciprocating drive shaft; and a second skirt attached to a second reciprocating drive shaft in the chute above the cavity drum and configured to swing back and forth via the second reciprocating drive shaft.

3. The metering device according to claim 1, further comprising an apron conveyor below the cavity drum onto which the filler material in the cavities is configured to be deposited as the cavity drum rotates.

4. The metering device according to claim 3, further comprising a scraper disposed adjacent the apron conveyer and comprising a scraper strip configured to scrape excess particles off the apron conveyer, a position of the scraper strip being adjustable relative to the apron conveyer.

5. The metering device according to claim 4, the scraper further comprising a base having a bar and two arms, wherein the arms are fastened to the chute, wherein the bar comprises two pins onto which the scraper strip hangs via first holes in the scraper strip that correspond to the two pins, respectively.

6. The metering device according to claim 5, the scraper further comprising a secondary strip hanging onto the two pins of the bar via two holes in the secondary strip that correspond to the two pins, respectively, wherein scraper strip is disposed between the bar and the secondary strip, wherein the bar further comprises at least one magnet, and wherein the secondary strip is made of a magnetic material and is attached to the bar via the at least one magnet.

7. The metering device according to claim 4, wherein the scraper strip is made of paper having a density of 200 grams per square meter (gsm) to 500 gsm.

8. The metering device according to claim 5, wherein the first holes of the scraper strip are disposed on an upper area thereof, and wherein the scraper strip further comprises second holes disposed on a lower area thereof opposite thereof, such that if the scraper strip is rotated 180° the second holes would correspond to the two pins, respectively, of the bar.

9. The metering device according to claim 1, further comprising a funnel portion disposed below the cavity drum and configured to funnel the filler material from the cavity drum to a passage that leads to a cigarette paper.

10. The metering device according to claim 9, wherein the funnel portion comprises two plates mounted below the cavity drum.

11. The metering device according to claim 1, the cavity drum comprising:

a mounting flange for operably attaching the cavity drum to the first sidewall; and a male coupling that operably connects to a female coupling attached to a drive shaft.

12. The metering device according to claim 1, wherein the plurality of cavities in the cavity drum extends along a length between the operator end and the drive end.

13. The metering device according to claim 1, further comprising a minimum level sensor.

14. The metering device according to claim 1, wherein the cavity drum is removable from the metering device for cleaning or changeover.

* * * * *